US006681469B2

(12) United States Patent
Damon

(10) Patent No.: US 6,681,469 B2
(45) Date of Patent: Jan. 27, 2004

(54) DECORATIVE ELEMENTS FOR PUMPKINS OR OTHER PIERCEABLE OBJECTS

(75) Inventor: Erin Elise Damon, Minneapolis, MN (US)

(73) Assignee: Hanover Accessories, Inc., Plymouth, MN (US)

( * ) Notice: Subject to any disclaimer, the term of this patent is extended or adjusted under 35 U.S.C. 154(b) by 149 days.

(21) Appl. No.: 10/068,681

(22) Filed: Feb. 6, 2002

(65) Prior Publication Data

US 2002/0108231 A1 Aug. 15, 2002

Related U.S. Application Data

(60) Provisional application No. 60/267,632, filed on Feb. 9, 2001.

(51) Int. Cl.[7] ..... B23P 11/00

(52) U.S. Cl. ..... 29/432; 446/100; 428/7; D21/661; D11/121

(58) Field of Search ..... 29/432; 40/607.03; 411/439, 489, 499, 459, 460; 446/100, 386, 391, 268; 434/256, 270; D11/121; 428/7; D21/577, 621, 625, 630, 661

(56) References Cited

U.S. PATENT DOCUMENTS

| | | | | | |
|---|---|---|---|---|---|
| 313,681 | A | * | 3/1885 | Overell | 411/460 |
| 1,292,113 | A | * | 1/1919 | Smith | 446/391 |
| 2,019,516 | A | | 11/1935 | Weinberg | |
| 2,729,023 | A | * | 1/1956 | Lerner et al. | 446/100 |
| 2,964,872 | A | * | 12/1960 | Coleman | 446/386 |
| 3,130,425 | A | * | 4/1964 | Kelly | 411/489 |
| 3,195,227 | A | * | 7/1965 | Prestige | 29/432 |
| 3,205,757 | A | * | 9/1965 | Kuennen | 411/498 |
| 3,210,884 | A | * | 10/1965 | Sharff et al. | 446/100 |
| 3,499,359 | A | * | 3/1970 | Yrjanainen | 29/432 |
| 3,533,890 | A | * | 10/1970 | Nesbit | D11/121 |
| 3,757,442 | A | * | 9/1973 | Cook | 40/617 |
| 3,822,170 | A | | 7/1974 | Smolen | |
| 4,660,310 | A | * | 4/1987 | Farmer | 40/607.03 |
| 4,711,800 | A | * | 12/1987 | DiVincenzo | 428/7 |
| D312,114 | S | * | 11/1990 | Moore | D21/661 |
| D315,001 | S | * | 2/1991 | Bennett | D21/661 |
| 5,091,833 | A | | 2/1992 | Paniaguas et al. | |
| 5,162,138 | A | | 11/1992 | Caflisch et al. | |
| 5,195,638 | A | | 3/1993 | Zinbarg | |
| 5,215,493 | A | * | 6/1993 | Zgrodek et al. | 446/268 |
| 5,380,237 | A | | 1/1995 | Kenyon | |
| D382,317 | S | * | 8/1997 | Huston | D21/661 |
| D384,595 | S | | 10/1997 | Hartwell-Ruland | |
| D397,955 | S | | 9/1998 | Schmidt | |
| D404,339 | S | | 1/1999 | Hughes | |
| 5,946,773 | A | | 9/1999 | Esker et al. | |
| 6,196,782 | B1 | * | 3/2001 | Wagner et al. | 411/439 |
| 2003/0026934 | A1 | * | 2/2003 | Damon | 428/43 |

* cited by examiner

*Primary Examiner*—David P. Bryant
(74) *Attorney, Agent, or Firm*—Merchant & Gould P.C.

(57) ABSTRACT

A decorative element for use on a pierceable object such as a pumpkin is provided which includes a decorative body and an insertion device. The decorative body defines an interior chamber. The interior chamber receives and is attached to the insertion device. Preferably, the insertion device is attached to the interior chamber with glue.

A method for attaching and removing a decorative element to a pierceable object, including grasping the decorative element at a grasping section, positioning decorative element in a desired location on pierceable object and inserting the insertion device into the pierceable object. Decorative element is removed from pierceable object by grasping decorative element at grasping section and applying force sufficient to remove the insertion device from the pierceable object.

14 Claims, 5 Drawing Sheets

DECORATIVE ELEMENTS FOR PUMPKINS OR OTHER PIERCEABLE OBJECTS

Priority

This application claims priority to provisional application, entitled, DECORATIVE ELEMENTS FOR TO PUMPKINS OR OTHER PIERCEABLE OBJECTS, Ser. No. 60/267,632, filed Feb. 9, 2001.

FIELD OF THE INVENTION

The present invention relates to decorative elements that can be used to create a face or other decoration on a pumpkin or snowman or like base. More particularly, the invention relates to an apparatus and a method for removably attaching decorative elements on a pumpkin or snowman or the like.

BACKGROUND OF THE INVENTION

Snowmen and pumpkins are examples of objects that are displayed to celebrate or identify a certain season or holiday. Snowmen are part of the tradition and fun of celebrating the winter season. Pumpkins are decorated to celebrate the Halloween holiday. Over the years, the tradition has grown to include decorating other objects in addition to pumpkins and snowmen. For example, Styrofoam forms have been used instead of snow to make snowmen for indoor use in seasonal displays.

The display of decorated pumpkins is part of the tradition and fun of Halloween. Originally, pumpkins were decorated by cleaning out the soft pulp on the inside, and carving openings representing at least eyes, nose, and mouth. A similar tradition exists in making snowmen during the winter season, wherein a face is often made using decorative elements, for example, a nose of coal and a carrot nose. In modern times, snowmen are often made of Styrofoam or other artificial materials, and kits of decorative elements are provided as described in U.S. Pat. Nos. 3,841,019; 4,322,004; and Des. 267,210.

The traditional method of decorating a pumpkin is a messy process involving the inconvenience of cleaning out the pumpkin seeds and the soft pulp and allowing for individualizing of the face. This method allows little margin for error, for example, changing of the position of carved features after they are made. For example, if an eye or mouth is placed at a location that is undesirable, it cannot be changed in position. Thus, kits are available which allow for placement and rearrangement of the facial elements, such as one example shown in U.S. Pat. No. 5,091,833. Kits have also evolved to include other decorative elements such as hats, jewelry, and other fanciful objects.

A limitation of the existing decorative elements for decorating pierceable objects is that insertion and removal of the decorative elements can be difficult. For example, when elements such as ears are attached to a pumpkin, a pin-type element is attached to a decorative body and inserted into the pumpkin. When the pin is inserted into the pumpkin or other like base, the pin becomes engaged in the soft pulpy material of the pumpkin. The fit between the pin and the pumpkin can create a suction or sticking, which makes it difficult to remove the pin from the pumpkin. Furthermore, decorations, made from soft material or paper or other similar material, are removed by pulling on the pin, thereby disengaging it from the pumpkin.

One disadvantage of using a pin or other like object in attaching a decorative element to a pierceable object such as a pumpkin or snowman is that the pin is hard to grasp, which makes removal difficult. Another disadvantage is that the decorative elements can become separated from the pin by shear forces created between the decorative element and pin due to the suction or sticking force created by the pin in the soft pumpkin. Thus, there exists a need for decorative elements that are easily attached and removed, while reducing the likelihood that a decorative body will separate from a insertion device during insertion and removal and also making the removal easier so that the effect of the suction at the interface between the insertion device and pierceable object is reduced.

SUMMARY OF THE INVENTION

A decorative element for a pierceable object comprising a decorative body defining an interior chamber, an insertion device having first and second ends, the first end including a grasping section received by the chamber, the grasping section further including a reduced diameter portion defining a grasping portion adjacent to the first end, the second end having distal and proximal sections, the second end having a taper from the distal section to the proximal section, the proximal section located adjacent to the grasping section of the first end of the insertion device.

A method for decorating a pierceable object comprising grasping a decorative element having a decorative body defining an interior chamber and an insertion device, the insertion device having first and second ends, the first end including a grasping section received by the chamber, the grasping section further including a reduced diameter portion defining a grasping portion adjacent to the first end, the second end having distal and proximal sections, the second end having a taper from the distal to the proximal section, the proximal section located adjacent to the grasping section of the first end of the insertion device, inserting the second end of the insertion device into a pierceable body, grasping the decorative element by the grasping portion, and removing the second end of the insertion device from the pierceable body.

DETAILED DESCRIPTION OF THE PREFERRED EMBODIMENTS

Figure 1:
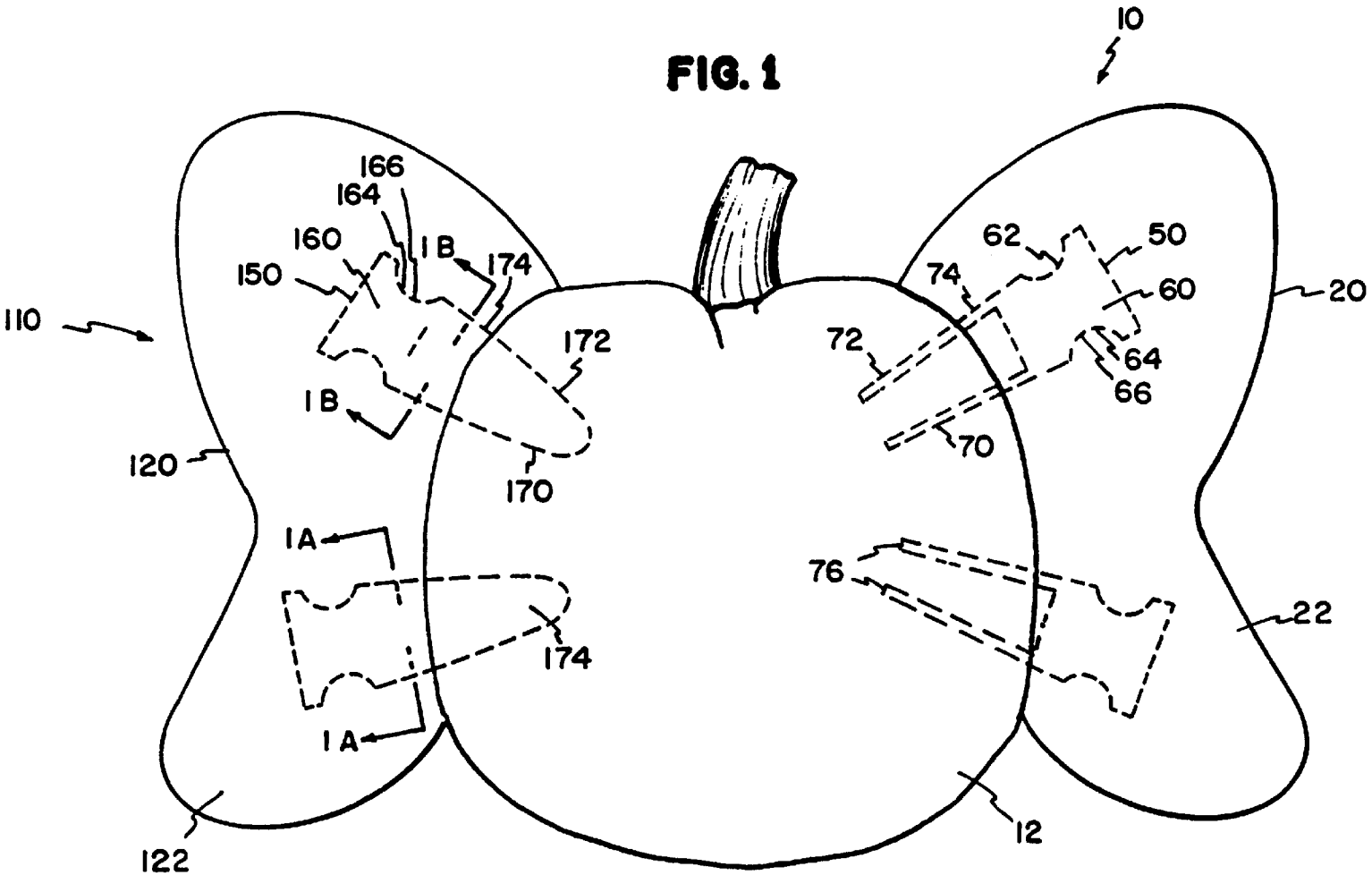
FIG. 1 is an elevation view of a pierceable object, such as a pumpkin, including a decorative element in accordance with the present invention.

FIG. 1 shows a pierceable object 12, in this illustration a pumpkin, having embodiments of decorative elements 10, 110 of the present invention attached to pierceable object 12. Although different embodiments of decorative elements 10, 110 are depicted attached to pierceable object 12, this is for illustration purposes.

In one preferred embodiment of the present invention, decorative element 10 includes a decorative body 20 defining an interior chamber 22 and an insertion device 50. Referring to FIG. 1, decorative body 20 is shown in the shape of an ear. Decorative body 20 can be shaped in a multitude of configurations, including an eye, nose, mouth, ears, hat, or hair. In one embodiment, decorative body 20 of decorative element 10 of the present invention is fabricated from a soft-material. Preferably, soft-material is felt, cotton, wool, or cloth. Decorative body 20 can also be made of other materials including paper, plastic, or rubber.

Figure 7:
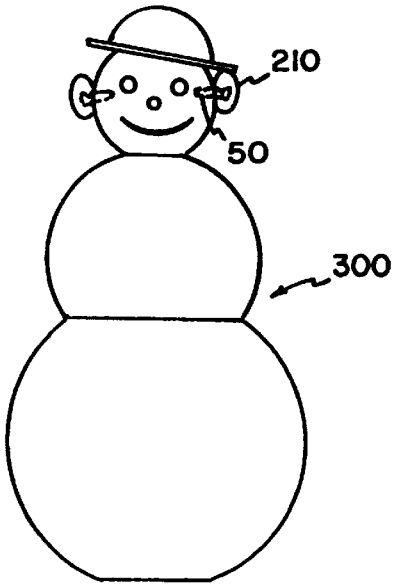
FIG. 7 is an elevation view of a pierceable object, such as a pumpkin, including a decorative element in accordance with the present invention.

As shown in FIG. 1, one embodiment of decorative element 10 of the present invention is shown attached to pierceable object 12 using a plurality of insertion devices 50. However, it is not necessary for decorative element 10 to be attached by a plurality of insertion devices 50, As shown in FIG. 7, decorative element 210 can be attached to pierceable object 300, in this case a snowman, using one insertion device 50.

In one preferred embodiment, insertion device 50 of decorative element 10 of the present invention is fabricated for a material of rigidity sufficient to withstand the pressure exert during insertion into and removal from pierceable object. Preferably insertion device 50 is made of wood or plastic. In another preferred embodiment of the present invention, insertion device 50 is made of metal. Preferably, insertion device 50 is made by molding or stamping.

As shown in FIG. 1, decorative element 10 is attached to pierceable object 12 by a plurality of insertion devices 50. Insertion device 50 further has a first end 60 and a second end 70. First end 60 includes a grasping section 62. Grasping section 62 includes a reduced diameter portion 64 defining a grasping portion 66. Second end 70 of insertion device 50 further includes a distal end 72 and a proximal end 74. Distal end 72 is capable of being removably secured to a pierceable object 12. Proximal end 74 is located adjacent to grasping section 62 of first end 60 of insertion device 50.

Figure 3:
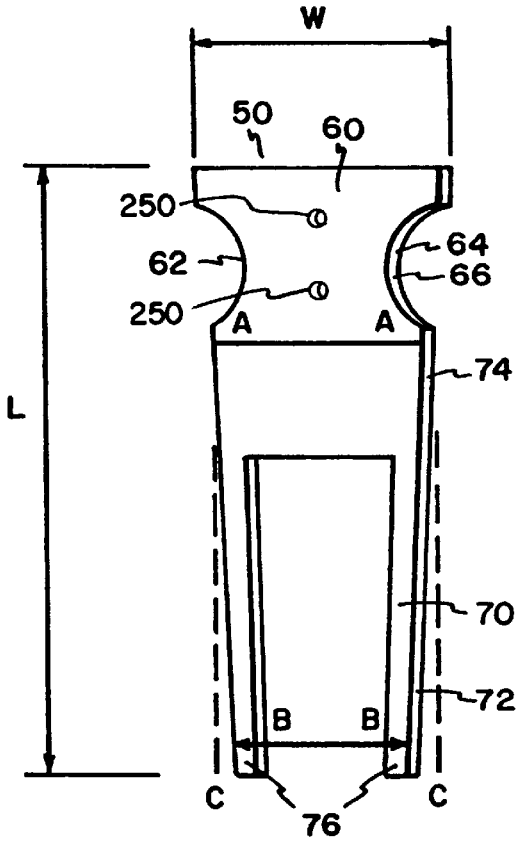
FIG. 3 is a perspective view of one preferred embodiment of an insertion device of one of the decorative elements of the present invention.

Referring to FIG. 3, in one preferred embodiment of insertion device 50 of decorative element 10 of the present invention, a taper is formed from first end 60 to second end 70. Taper is defined by width of the proximal section 74 of second end 70, defined by line A—A being greater than width of distal section 72 of second end 70, defined by line B—B. Tapering proximal section 74 relative to distal section 72 assists insertion and removal of second end 70 of insertion device 50 into and from pierceable object 12.

Referring to FIG. 3, in one preferred embodiment, insertion device 50 of decorative element 10 of the present invention has a width W measured along line WW. Preferably, W is between 0.1 and 10 inches. More preferably, W is between 0.5 and 2.0 inches. Most preferably, W is about 1.5 inches. Insertion device 50 of decorative element 10 of the present invention has a length L measured along line L—L. Preferably, L is between 0.25 and 10 inches. More preferably, L is between 0.5 and 4.0 inches. Most preferably, L is about 3.5 inches. Insertion device 50 of decorative element 10 of the present invention has a length thickness T measured along line T—T. Preferably, T is between 0.0125 and 0.5 inches. More preferably, T is between 0.0575 and 0.25 inches. Most preferably, T is about 0.125 inches. Thickness T does not have to be uniform over length L of insertion device 50.

Figure 2:
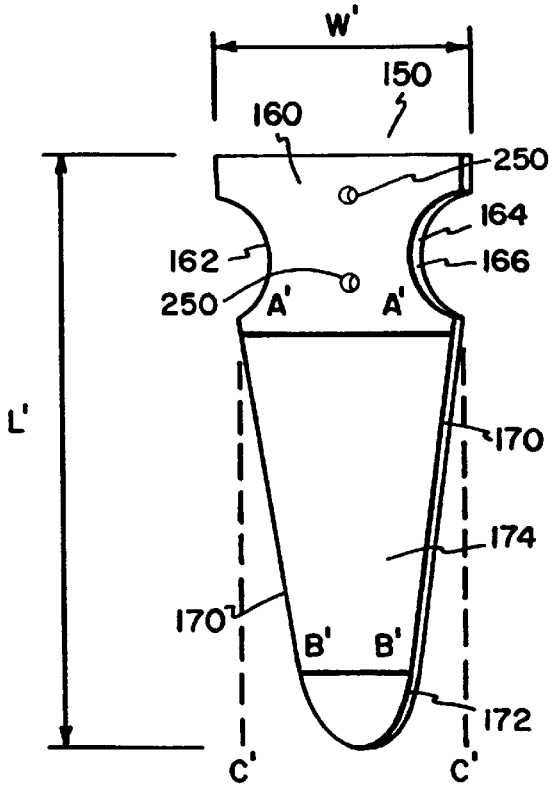
FIG. 2 is a perspective view of one preferred embodiment of an insertion device of one of the decorative elements of the present invention.

Referring to FIG. 2, in one preferred embodiment of insertion device 150 of decorative element 110 of the present invention, a taper is formed from first end 160 to second end 170. Taper is defined as the width of the proximal section 174 of second end 170, defined by line A'—A' being greater than width of distal section 172 of second end 170, defined by line B'—B'. Tapering proximal section 174, relative to distal section 172, assists insertion and removal of second end 170 of insertion device 150 into and from, respectively, pierceable object 12.

Referring to FIG. 2, in one preferred embodiment, insertion device 150 of decorative element 110 of the present invention has a width W' measured along line W'—W'. Preferably, W' is between 0.1 and 10 inches. More preferably, W is between 0.5 and 2.0 inches. Most preferably, W' is about 1.5 inches. Insertion device 150 of decorative element 110 of the present invention has a length L' measured along line L'—L'. Preferably, L' is between 0.25 and 10 inches. Preferably, L' is between 0.5 and 4.0 inches. Most preferably, L' is about 3.5 inches. Insertion device 150 of decorative element 110 of the present invention has a length thickness T' measured along line T'—T'. Preferably, T' is between 0.0125 and 0.5 inches. Preferably, T' is between 0.0575 and 0.25 inches. Most preferably, T' is about 0.125 inches. Thickness T' does not have to be uniform over length L' of insertion device 150.

Referring to FIG. 2, one preferred embodiment of insertion device 150 of decorative element 110 of the present invention includes second end 170 having a unitary insertion piece 174. FIG. 1 shows unitary insertion piece 174 removably secured to pierceable object 12. When insertion piece 174 is removably secured to pierceable object 12, decorative element 110 can be positioned and repositioned as necessary to complete overall effect desired. Also, insertion device 150 optionally can include holes 250 that can be used in stitching decorative element (not shown) to insertion device 150.

As shown in FIG. 1, one preferred embodiment of insertion device 50 of decorative element 10 of the present invention includes second end 70 having a plurality of prongs 76. Prongs 76 are capable of being removably secured to pierceable object 12 and decorative element 10 can be repositioned as necessary to complete overall effect desired. Preferably, second end 70 has 2 to 6 prongs 76. More preferably, second end 70 has 2 to 4 prongs 76. Most preferably, second end 70 has 2 prongs 76.

Figure 4:
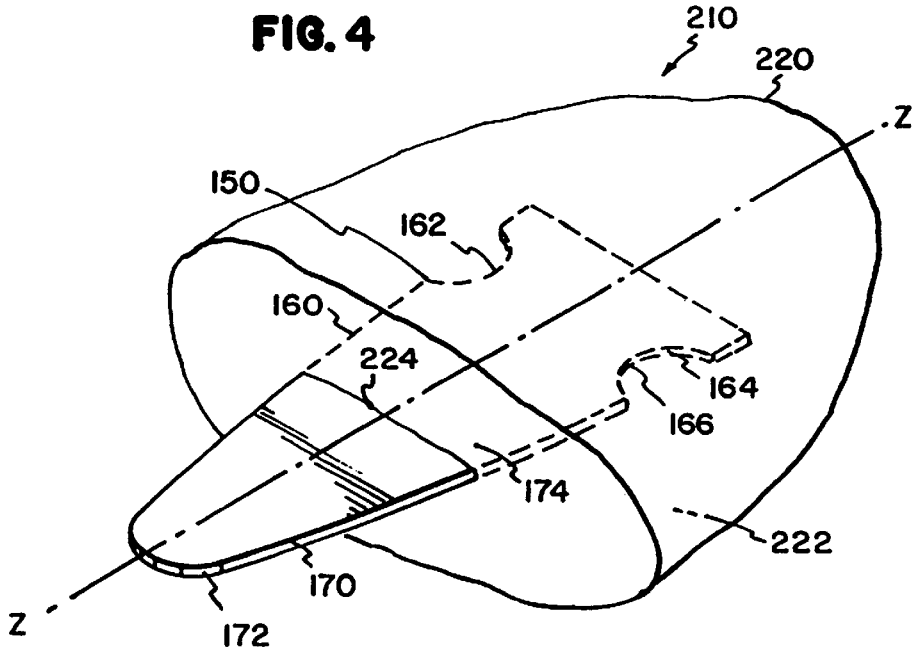
FIG. 4 is a perspective view of a decorative element of the present invention.

Referring to FIG. 4, in one preferred embodiment, insertion device 150 of decorative element 100 of the present invention is capable of being received into interior chamber 222 of decorative body 220. In one embodiment, decorative body 220 further has an opening 224 for receiving insertion device 150. Decorative body 120 is secured to insertion device 150. While it is recognized that various methods can be used to secure decorative body 120 to insertion device 150, gluing or stapling is preferred. Insertion device 150 can also be secured to decorative body 120 by designing opening 224 to have a width that is less than or equal to the width of proximal section 174 defined by line A'—A', as shown in FIG. 2. As shown in FIG. 4, only distal section 172 of insertion device 150 protrudes from decorative body 120. Proximal section 174 of second end 170 is secured within interior chamber 122 at a point where width of second end 170 along taper between distal section 172 and proximal section 74 is greater than width of opening 124.

Figure 1B:
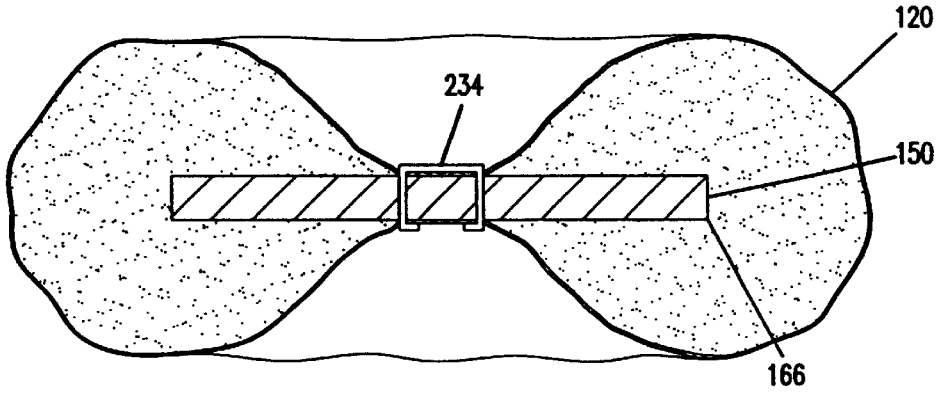
FIG. 1B is a section view of one of the decorative elements of FIG. 1 along line 1B—1B.
Figure 1A:
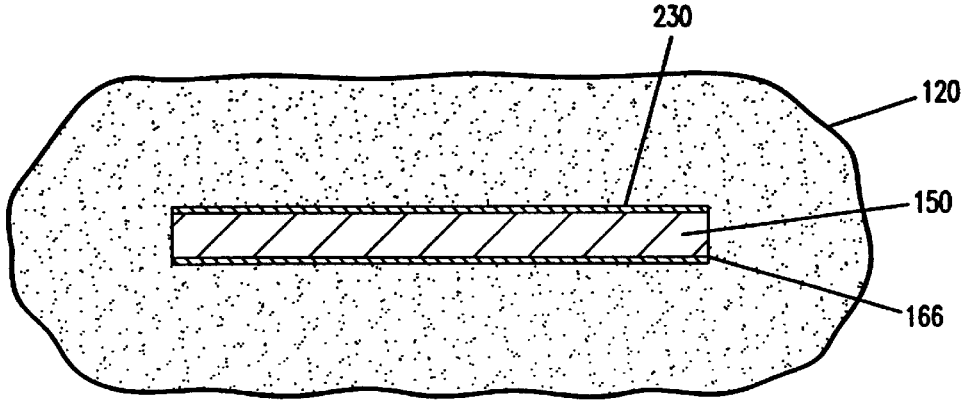
FIG. 1A is a section view of one of the decorative element of FIG. 1 along line 1A—1A.

In one embodiment of decorative element 110 of the preferred invention, insertion device 150 is received by interior chamber 122, as shown in FIG. 1. Insertion device 150 is attached to interior chamber 122. As shown in FIG. 1A, glue 230 is located at an interface 232 between decorative body 120 and insertion device 150 at or near grasping portion 166. Referring to FIG. 1B, in one of the embodiments of decorative element 110 of the present invention, a staple 234 secures decorative body 120 to insertion device 150 near or at grasping portion 166. In addition to glue 230 or staple 234, alternative means may be used to attach insertion device to decorative body, including fasteners or adhesives.

Figure 5:
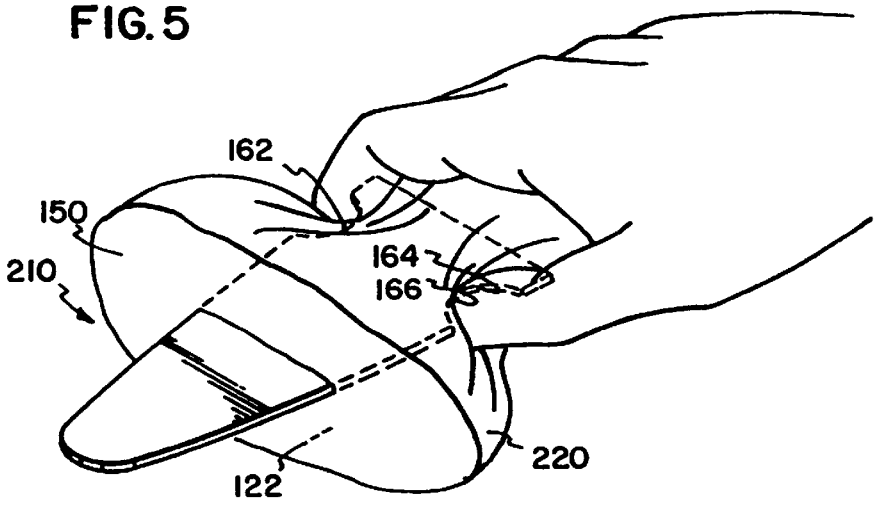
FIG. 5 is a perspective view of a decorative element of the present invention.

Referring to FIG. 5, one preferred embodiment of insertion device 150 of decorative element 210 of the present invention includes grasping section 162 for holding decorative element 210 during insertion into and removal from pierceable object 12. Grasping section 160 is received into interior chamber 122 of decorative body 120. Grasping section 160 further has reduced diameter portion 164 defining grasping portion 126. In one embodiment of insertion device 150 of decorative element 210 of the present invention, grasping portion 124 is semi-circular.

Figure 6:
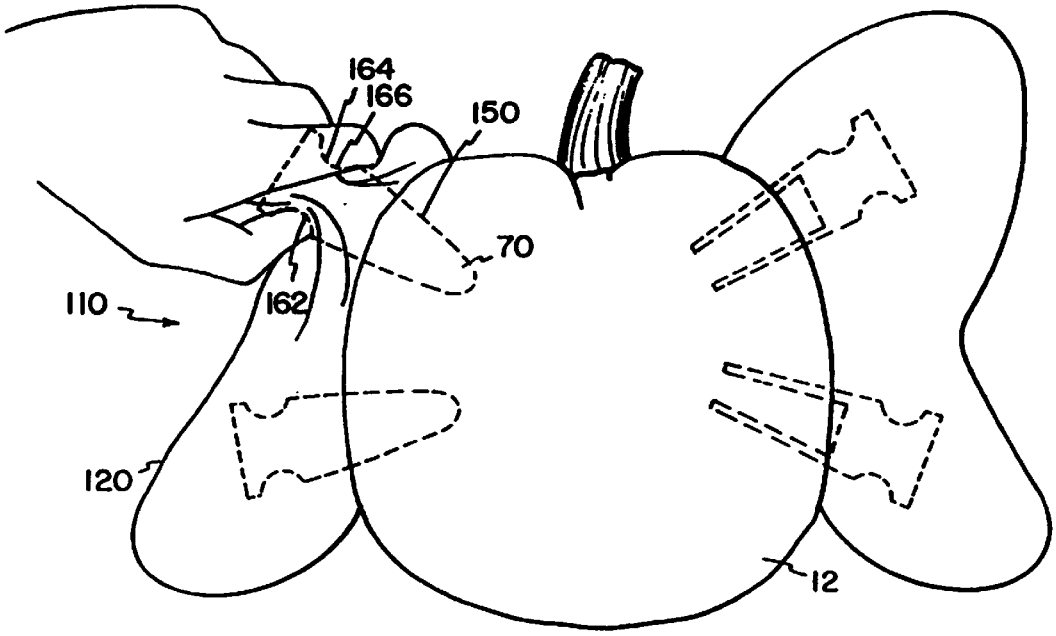
FIG. 6 is an elevation view of decorative element of the present invention removably secured to a pierceable object.

The present invention also includes a method of removably securing decorative element 10, 110, 210 to pierceable object 12. Referring to FIG. 6, one embodiment of the method of the present invention includes attachment and removal of decorative element 110 to and from pierceable object 12, in this case a pumpkin. Attachment of decorative element 110 is accomplished by grasping decorative element 110. During grasping, decorative body 120 is gathered around grasping portion 166. Gathering decorative body 120 around grasping portion 166 minimizes shear forces between insertion device 150 and decorative body 120 during insertion and removal of second end 170 of insertion device 150 in pierceable object 12. After grasping decorative element 110, second end 170 of insertion device 150 is inserted at a suitable location on pierceable object 12. Removal of decorative element 110 from pierceable object 12 is accomplished by grasping decorative element 110 by grasping portion 166 and removing second end 170 of insertion device 150 from pierceable body 12.

In one embodiment of the present invention, pierceable object 12 is a pumpkin. Pierceable object 12 can also be a snowman or other object made from snow, a squash, a Styrofoam ball or object. Referring to FIG. 7, decorative element 310 is shown attached to a snowman 300. Preferably, snowman 300 is made of snow or Styrofoam. In the embodiment shown, decorative element 310 represents an ear, although decorative element 310 can be shaped to represent a variety of features, including, but not limited to, hats, hair, eyes, nose, or mouth.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A decorative element for a pierceable object, comprising:

a decorative body defining an interior chamber;

a substantially planar insertion device having first and second ends, the first end being attached to the interior chamber;

the first end including a grasping section received by the chamber;

the grasping section further including a reduced diameter portion defining a grasping portion adjacent to the first end, the grasping portion being defined between recesses formed in opposite edges of the grasping section; and the second end having distal and proximal sections, the second end having a taper from the proximal to the distal section, the proximal section located adjacent to the grasping section of the first end of the insertion device, the distal section being adapted to pierce the pierceable object.

2. The decorative element of claim 1 wherein the decorative body is made of felt.

3. The decorative element of claim 1 wherein the recesses are semi-circular in shape.

4. The decorative element of claim 1 wherein the pierceable object is a pumpkin.

5. The decorative element of claim 1 wherein the pierceable object is a Styrofoam ball.

6. The decorative element of claim 1 wherein the pierceable object is a squash.

7. The decorative element of claim 1 wherein the pierceable object is a snowman.

8. The decorative element of claim 1 wherein the first end is attached to the interior chamber with a glue interface.

9. The decorative element of claim 1 wherein the first end is attached to the interior chamber with a staple.

10. The decorative element of claim 1 wherein the insertion device includes a plurality of holes located on the second end.

11. A method for decorating a pierceable object, comprising:

grasping a decorative element having a decorative body defining an interior chamber and a substantially planar insertion device, the insertion device having first and second ends, the first end including a grasping section received by the chamber, the grasping section further including a reduced diameter portion defining a grasping portion adjacent to the first end, the grasping portion being defined between recesses formed in opposite edges of the grasping section, the second end having distal and proximal sections, the second end having a taper from the proximal to the distal section, the proximal section located adjacent to the grasping section of the first end of the insertion device; and inserting at least the distal section of the second end of the insertion device into a pierceable object to thereby decorate the pierceable object with the decorative element.

12. A method according to claim 11 wherein the pierceable object is a pumpkin.

13. A method according to claim 11 wherein the pierceable object is a Styrofoam object.

14. The method of claim 11, further comprising removing the decorative element from the pierceable object by grasping the decorative element by the grasping portion of the insertion device, and removing the second end of the insertion device from the pierceable object.

* * * * *